United States Patent [19]

Bleckmann et al.

[11] 4,251,720

[45] Feb. 17, 1981

[54] HEATER ASSEMBLY

[76] Inventors: Ingo Bleckmann, Ignaz-Rieder-Kai 11, Salzburg; Wilhelm Adam, Reisenbergerstrasse 21, A-5020 Salzburg, both of Austria

[21] Appl. No.: 100,124

[22] Filed: Dec. 4, 1979

[30] Foreign Application Priority Data

Dec. 6, 1978 [DE] Fed. Rep. of Germany ..... 2852808

[51] Int. Cl.[3] ..... H05B 3/08

[52] U.S. Cl. ..... 219/541; 219/436; 219/447; 338/274; 338/238; 29/619

[58] Field of Search ..... 219/402, 403, 436, 438, 219/439, 447, 5, 541, 544; 338/236, 273, 274; 29/611, 619

[56] References Cited

U.S. PATENT DOCUMENTS

| | | | |
|---|---|---|---|
| 2,914,650 | 11/1959 | Sheahan | 219/436 |
| 2,963,569 | 12/1960 | Levine et al. | 219/436 |
| 3,102,248 | 8/1963 | Temple | 338/274 |
| 3,113,284 | 12/1963 | Van Inthoudt | 338/274 |
| 3,230,492 | 1/1966 | Drugmand et al. | 338/274 |
| 3,259,732 | 7/1966 | Jepson | 219/436 |
| 3,387,363 | 6/1968 | Boggs | 29/619 |
| 3,513,540 | 5/1970 | Boggs | 29/611 |
| 3,560,704 | 2/1971 | Albert | 219/541 X |

FOREIGN PATENT DOCUMENTS

| | | | |
|---|---|---|---|
| 1128060 | 4/1962 | Fed. Rep. of Germany | 219/436 |

*Primary Examiner*—Volodymyr Y. Mayewsky
*Attorney, Agent, or Firm*—Fleit & Jacobson

[57] ABSTRACT

A heater assembly for a container such as a cooking vessel includes a heating coil in a tubular heater casing, with a connecting pin member connected to the heating coil and projecting through an insulating sleeve mounted to the end of the casing. A plug connecting pin is mounted to the part of the pin member projecting from the insulating sleeve. The end of the casing is butted directly against the insulating sleeve, and a casting material is cast around parts of the plug pin, the casing and the insulating sleeve to form an assembly thereof.

6 Claims, 3 Drawing Figures

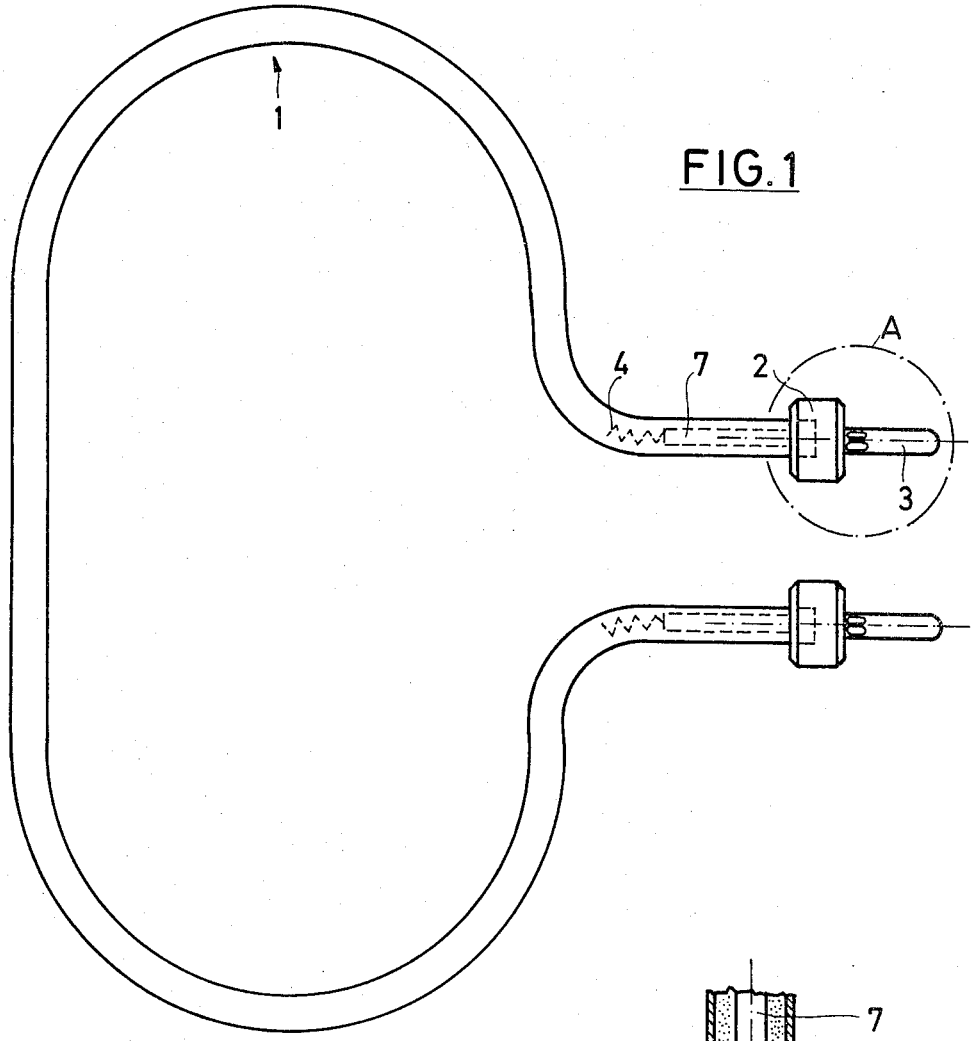
FIG. 1
FIG. 2
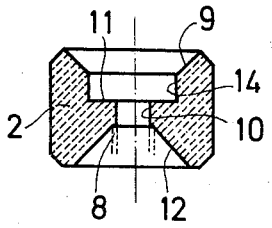
FIG. 3
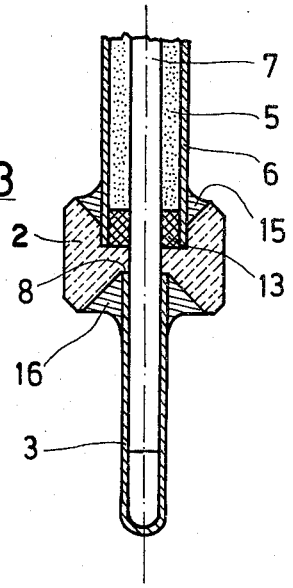

HEATER ASSEMBLY

BACKGROUND OF THE INVENTION

It is known for containers such as boiling devices, cooking vessels, frying or roasting pans or the like, to be heated by means of a heater assembly comprising a tubular casing in which a heating coil is disposed. In order to form an end seal at the ends of the heating assembly, where it extends out of the container, a connection pin member which is connected to the heating coil in the tubular heater casing is passed through an insulating sleeve in the wall of the container and the part of the connection pin member which projects out of the insulating sleeve is provided with a plug connecting pin for connection to an electrical plug.

However in a tubular heater assembly of this kind, there is often the problem that mechanical forces acting on the plug pin, and repeated expansion and contraction phenomena in the heater assembly result in the seal becoming loose so that water can penetrate to the electrical components when the vessel is being cleaned, and can thereby impair the insulation thereof.

In addition, temperatures of up to about 250° C. will often occur at the connection ends of the tubular heater, so that silicone rubber discs which are normally used for sealing purposes at those locations can no longer satisfactorily carry out their function as a result of the flow behaviour of silicone rubber at such temperatures, and subsequent hardening.

In order to ensure that no water can reach the end of the heater coil in the casing, German Auslegeschrift No. 1 128 060 discloses an end seal means which is intended to overcome the above-indicated problems. In this disclosed end seal means, an intermediate disc is provided between the end surface of the tubular casing and the inwardly facing end surface of a sleeve or bush, for example of boron silicate glass, which in turn is pressed with its edge portion against the wall of the vessel or container by way of a further interposed sealing ring, by a rearward flange portion on the plug pin fixed on the outwardly projecting part of the connection pin member of the heater assembly.

However, this construction does not take into account the fact that forces which act on the plug pin when the electrical connection cable is frequently plugged in and disconnected, can result in the connection pin member becoming loose in the insulating material, thereby reducing the pressure force applied by the sleeve to the side wall of the vessel and by the intermediate disc to the end surface of the tubular casing, and this ultimately also results in a loss of sealing action.

SUMMARY OF THE INVENTION

An object of the invention is to provide a heater assembly which has a satisfactory end seal.

A further object of the invention is to provide an end seal for a tubular heater assembly which employs simple means and which is capable of withstanding mechanical forces which may act on a plug connector pin thereof.

A still further object of the invention is to provide a heating assembly for a vessel such as a boiling vessel, cooking pan or the like, which can be easily manufactured.

These and other objects are achieved by means of a heating assembly comprising a tubular casing within which there is a resistance heating means. At each end of the casing, the heating means is connected to a respective connecting pin member which extends through an insulating sleeve on the casing end portion. The part of the connecting pin member which projects out of the insulating sleeve is provided with a plug pin for connection to an electrical plug. The respective end surface of the casing is butted and supported directly against the insulating sleeve while the plug pin, casing and insulating sleeve are cast together to form a coherent assembly by means of a suitable casting material.

In an advantageous embodiment, the insulating sleeve has a recess therein and the end surface of the tubular casing is engaged into the recess and butts against an end or bottom surface thereof.

The invention also provides a method of producing a tubular heater assembly as set forth above, wherein the connecting pin member is fitted into the tubular casing, being connected to the electrical heating means end therein, the insulating sleeve is pushed over the connecting pin member on to the tubular casing, the plug pin is pushed on to the connecting pin member until the plug pin butts against the insulating sleeve, the plug pin is pressed to the connecting pin member whereby the plug pin and the connecting pin member are secured together, and casting or teeming material is run into recesses in the insulating sleeve around the plug pin and the connecting pin member, thereby to form a coherent assembly comprising the casing, the plug pin, the connecting pin member and the insulating sleeve.

BRIEF DESCRIPTION OF THE DRAWINGS

FIG. 1 shows a plan view of an embodiment of a tubular heater assembly.

FIG. 2 shows a view in cross-section of an insulating sleeve of the FIG. 1 embodiment, and FIG. 3 shows a sectional view on a larger scale of the part indicated at A in FIG. 1.

DESCRIPTION OF THE PREFERRED EMBODIMENT

Referring to the drawings, FIGS. 1 and 3 show a tubular heater assembly which is secured for example to the underside of the bottom of a container such as a boiling or cooking vessel or a frying or roasting pan (not shown in the drawing), and which comprises a suitably curved or bent tubular heater member 1 in a loop-like configuration, two insulating sleeves 2 and two plug connecting pins 3 which project out of the insulating sleeves 2. The heater member 1 includes a resistance means 4 in the form of a wire heating coil which is embedded in a compacted mass of heat-resistant insulating material 5 in powder form, for example magnesium oxide, and a tubular casing 6 which encloses the resistance means 4 and the insulating material 5. At each end of the heater member 1, a connecting pin member 7 which is electrically conductingly connected to the resistance means 4 extends partly through the material 5, ie a part of each pin member is embedded in the material 5, so as to connect to the resistance means 4. In the embodiment illustrated, the heat-resistant insulating material 5 does not extend as far as the end surface of the tubular heater casing 6 but terminates a short distance before the end surface of the casing 6, thereby leaving a recess into which a seal 13 with a central opening corresponding to the diameter of the connecting pin member 7 can be fitted (FIG. 3).

A generally cylindrical insulating sleeve 2 comprising a refractory material such as for example tetrafluoroethylene is pushed on to the end of the heater casing 6, over the connecting pin member 7 which projects out of the end of the tubular heater member 1. The insulating sleeve 2 has two generally cylindrical recesses or sockets 10 and 14 which as illustrated are of different diameters, the socket 10 being in the form of a bore communicating with the socket 14. The socket 14 accommodates the end portion of the heater casing 6 while the connecting pin member 7 is a snug fit through the bore of the socket 10. The end of the heater casing 6 thus butts against a shoulder 11 formed by the socket 14 in the insulating sleeve 2. In addition, as shown more particularly in FIG. 2, the insulating sleeve 2 has a frustoconical or tapered recess or depression 9 and 12 respectively in each of the upper and lower surfaces of the insulating sleeve 2. The recesses 9 and 12 serve on the one hand as a means for facilitating assembly of the heater casing 6 to the sleeve 2, and on the other hand as a space for accommodating a filling or casting material 15. The diameters of the sockets 10 and 14 correspond on the one hand to the diameter of the casing 6 of the tubular heater member, and on the other hand to the diameter of the connecting pin member 7. The sockets 10 and 14 which are disposed on respective sides of the insulating sleeve 2 are joined together, defining a step-like configuration, approximately at the centre of the insulating sleeve 2, and thus form the step or shoulder 11 against which the end of the heater casing 6 bears. The general arrangement of the sockets 10 and 14 and the tapered recesses 9 and 12 is particularly clearly shown in FIG. 2.

A plug pin 3 which is for example brass nickel-plated, and which may be of a round or flat configuration, is fitted on to the part of the connecting pin member 7 which projects out of the insulating sleeve 2, the plug pin 3 bearing against the insulating sleeve 2. The insulating sleeve 2 preferably has a peripheral shoulder 8 at the position of abutment of the plug pin 3 thereagainst, in order to provide a better support for the plug pin 3. The plug pin 3 is pressed to the connecting pin member 7 in the vicinity of the insulating sleeve 2, whereby the insulating sleeve is mechanically secured in place.

Casting material as shown at 15 and 16 is run into the parts of the tapered recesses 9 and 12 which remain open around the ends of the heater casing 6 and the plug pin 3 respectively, after assembly of the insulating sleeve 2. The casting material 15 and 16 reliably prevents water from penetrating into the tubular heater. Suitable casting materials are in particular heat-resistant casting resins or the like.

It will be appreciated that the described end seal for the tubular heater assembly requires a small number of components on the one hand, and, on the other hand, producing the end seal essentially requires only four working steps which are easy to carry out, as follows:

(a) Pushing the insulating sleeve 2 over the connecting pin member 7 on to the heater casting 6, the tapered recess 9 at the mouth of the bore socket 14 facilitating centring of the casing 6 when it is inserted into position, the casing thus being supported directly at the sleeve 2;

(b) Pushing the plug pin 3 on to the part of the connecting pin member 7 which projects out of the insulating sleeve 2, until the plug pin 3 butts against a shoulder 8 provided in the insulating sleeve 2;

(c) Pressing the plug pin 3 to the connecting pin member 7 in the vicinity of the insulating sleeve 2, whereby the two parts are secured together. As the plug pin 3, when secured in position, also bears against the shoulder 8 in the insulating sleeve 2, the insulating sleeve 2 is consequently also secured to the heater member 1;

(d) Running casting material 15, 16 into the recesses, 9 and 12 which remain on both sides of the insulating sleeve 2. This can be effected extremely easily as, due to the preceding operation of pressing the plug pin 3 to the connecting pin member 7, the heater assembly can be turned round as required for filling the back of the sleeve 2 with casting material, without the insulating sleeve 2 and the plug pin 3 being able to slip off the heater casing 6 and the connecting pin member 7 respectively.

In practice, the forces which act on the plug pin 3 due to the electrical connecting cable being plugged in and disconnected, are transmitted directly to the stable and strong heater casing 6, only by way of the insulating sleeve 2. Accordingly, the end seals are not subjected to a mechanical loading, and the plug pin can no longer become loose in the course of use of the heater.

Various modifications may be made without thereby departing from the scope and spirit of the present invention.

I claim:

1. A heater assembly for a container, comprising a tubular casing having an end portion and a heating resistance wire coil embedded in a heat-resistant insulating material in said casing, an insulating sleeve on said end portion of the casing, said end portion being supported directly against said insulating sleeve, a connecting pin member which is operatively connected to the heating resistance wire coil and which projects outwardly therefrom through the insulating sleeve, a plug connecting pin on the portion of the pin member projecting out of the insulating sleeve, and a casting material around respective parts of the plug connecting pin, the tubular casing and the insulating sleeve to form an assembly thereof.

2. An assembly as set forth in claim 1 wherein said plug connecting pin has a peripheral edge which butts and is supported directly against said insulating sleeve.

3. An assembly as set forth in claim 1 wherein said plug connecting pin is pressed to the pin member.

4. An assembly as set forth in claim 1 wherein said insulating sleeve has a first recess means for receiving the end portion of said tubular casing, and a second recess means for receiving a portion of said plug connecting pin, said first and second recess means providing depressions around said tubular casing end portion and said plug connecting pin portion for receiving said casting material.

5. An assembly as set forth in claim 1 wherein said tubular casing has two ends, and a respective sleeve, connecting pin member, plug connecting pin and casting material are operatively associated with each said end.

6. A tubular heater assembly for a vessel, comprising a tubular casing having an end portion, a heating resistance wire coil embedded in heat-resistant insulating material in the casing, an insulating sleeve on the end portion of the casing, a connecting pin member connected to the resistance wire coil and projecting out of the casing through the sleeve, and a plug connecting pin means disposed on the connecting pin member, for connection to an electrical plug, the improvement that the end surface of the casing end portion is supported directly against the sleeve by a peripheral edge of said plug connecting pin bearing against the sleeve and by the plug connecting pin being pressed on said connecting pin member, and that a casting material is cast around parts of the sleeve, the plug connecting pin and the casing.

* * * * *